US005502962A

United States Patent [19]

Butti

[11] Patent Number: 5,502,962

[45] Date of Patent: Apr. 2, 1996

[54] JOINTED UNIT COMPOSED OF ADJACENT ELEMENTS WHICH CAN ROTATE IN RELATION TO ONE ANOTHER

[75] Inventor: Luciano Butti, Novazzano, Switzerland

[73] Assignee: Valcambi S.A., Balerna, Switzerland

[21] Appl. No.: 256,389

[22] PCT Filed: Nov. 23, 1993

[86] PCT No.: PCT/EP93/03279

§ 371 Date: Jul. 7, 1994

§ 102(e) Date: Jul. 7, 1994

[87] PCT Pub. No.: WO94/12069

PCT Pub. Date: Jun. 9, 1994

[30] Foreign Application Priority Data

Dec. 2, 1992 [CH] Switzerland ..... 3687/92

[51] Int. Cl.[6] ..... F16G 13/08

[52] U.S. Cl. ..... 59/80; 59/901

[58] Field of Search ..... 59/78, 80, 35.1, 59/901

[56] References Cited

U.S. PATENT DOCUMENTS 1,893,256 1/1933 Wachenheimer .

4,930,304 6/1990 Meister ..... 59/80

FOREIGN PATENT DOCUMENTS 124770 5/1931 Austria ..... 59/80
593032 8/1977 Switzerland ..... 59/80
663136 11/1987 Switzerland .
669316 3/1989 Switzerland .
676414 1/1991 Switzerland .
331155 6/1930 United Kingdom .

*Primary Examiner*—David Jones
*Attorney, Agent, or Firm*—Young & Thompson

[57] ABSTRACT

A jointed unit (1) has several adjacent elements (2, 3) connected to one another by a pair of connecting members (5, 6) situated at opposite ends in which they are connected so as to be able to rotate. The members (5, 6), which include the pair of adjacent elements (2, 3) are made integral with one another by a fastening bar (4) connected to the members (5, 6) by screws (7) in a reversible manner. In one embodiment, the members (5, 6) are a pair of links, each having two cylindrical blind holes (5*c*, 5*d*, 6*c*, 6*d*) into which studs (2*c*, 2*d*, 3*c*, 3*d*) engage and protrude from the ends of the elements (2, 3) to be connected together.

3 Claims, 3 Drawing Sheets

JOINTED UNIT COMPOSED OF ADJACENT ELEMENTS WHICH CAN ROTATE IN RELATION TO ONE ANOTHER

BACKGROUND OF THE INVENTION

1. Field of the Invention

The invention concerns jointed units suitable for forming, in the field of jewelry making, bracelets, bands, ear rings, etc, and, in the field of mechanics in the broad sense, members such as transmission chains, belts and similar devices.

2. Description of the Related Art

In the course of the present, a detailed explanation will be provided of a unit particularly suited to use in jewelry making, but its manner of use in a different field will be able to be deduced in an obvious and immediate way by a technician skilled in each branch of application. To the applicant it does not seem that in prior art there are known units having characteristics analogous to those of the unit of the present invention.

The same applicant has also filed Swiss patent application no. 3177/91-2 which described a jointed unit which, among other things, exhibited the advantage of not requiring soldering or other types of complex machining that also would be potentially harmful to the final technical and aesthetic result, but the invention according to the application, besides conferring on the final product the same advantages as the above mentioned unit, has in relation to it the further technical advantage of offering equal resistance to mechanical stresses and to wear by using component parts of lesser weight, which, in the field of jewelry making, as well as in the dynamic uses of the unit, represents a significant technical advance.

The object of the invention is a jointed unit composed of several adjacent elements connected to one another by a pair of members called links, located at the opposite ends of the elements themselves, to which they are connected in such a way that they can rotate, while the members of said links that are components of the pair are made integral to one another by a fastening means connected to them in a reversible manner.

BRIEF DESCRIPTION OF THE DRAWINGS

The detailed description of the invention will be made according to two preferred embodiments, with reference being made to the attached drawings in which.

DETAILED DESCRIPTION OF THE PREFERRED EMBODIMENTS

Figure 1:
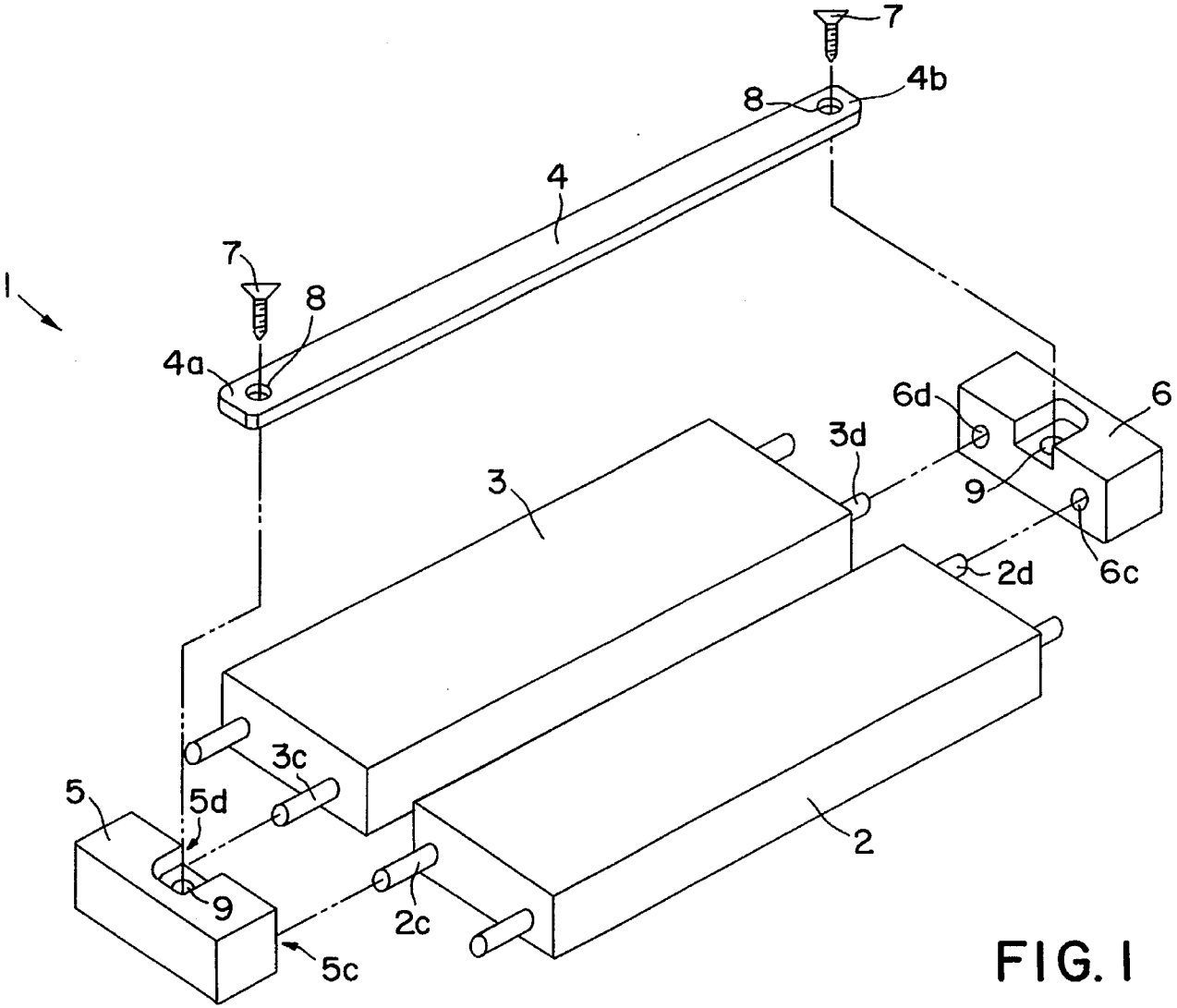
FIG. 1 represents an exploded view of the unit according to a preferred embodiment of the invention limited to two adjacent elements connected to one another.

In one preferred embodiment (see FIG. 1), the two adjacent elements 2, 3 of a jointed unit 1 exhibit on each end two protruding small studs.

Small studs 2*d*, 3*d* and 2*c*, 3*c* of the ends of the two elements 2, 3 engage into the same number of cylindrical holes 6*c*, 6*d* and 5*c*, 5*d* preferably blind, made on two connecting members or links 5, 6 which form a pair, and situated on opposite sides in relation to elements 2, 3.

The connection among the small studs and the corresponding holes must be such so as to allow the relative rotation of the parts among themselves without excessive play.

The two links 5, 6 are then integral with one another by means of a fastening member, which in the present embodiment is made up of a bar 4 connected to each one of them at its opposite ends 4*a* and 4*b* by fastening screws 7 passed through bores 8 into recessed threaded blind holes 9.

Bar 4 is situated in an intermediate position between the two adjacent elements 2, 3 in such a way that it is possible, by changing the shape of the elements themselves, to cover it in whole or in part, or to leave it completely visible.

Figure 3:
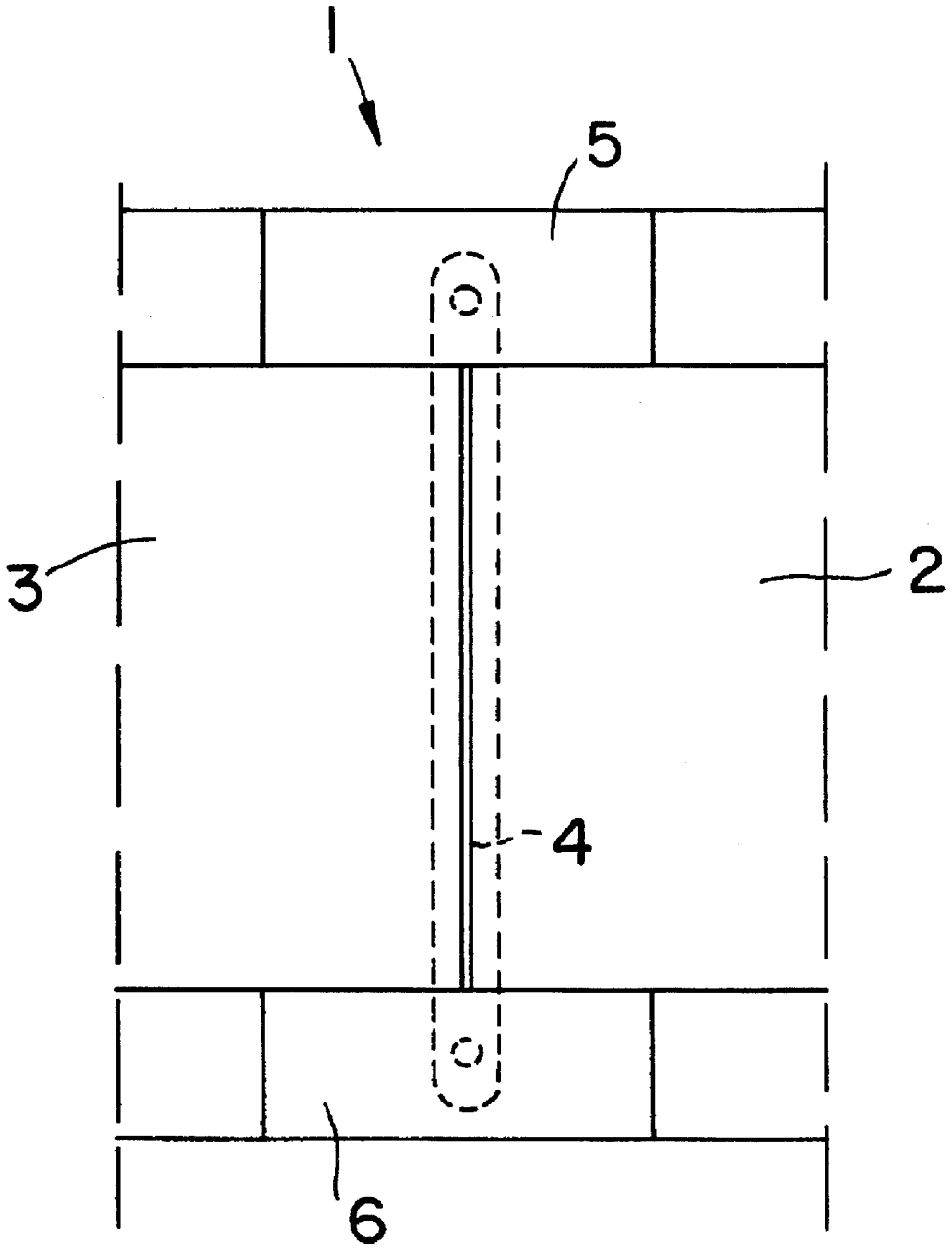
FIG. 3 represents a plan view of the unit with the component parts assembled in both embodiments.

By making an appropriate choice of the material with which bars 4 are made, it is therefore possible to obtain the desired chromatic play and the relief effect sought for each particular embodiment. (For this purpose see FIG. 3 in which bar 4 is completely hidden by the adjacent elements 2, 3).

Figure 2:
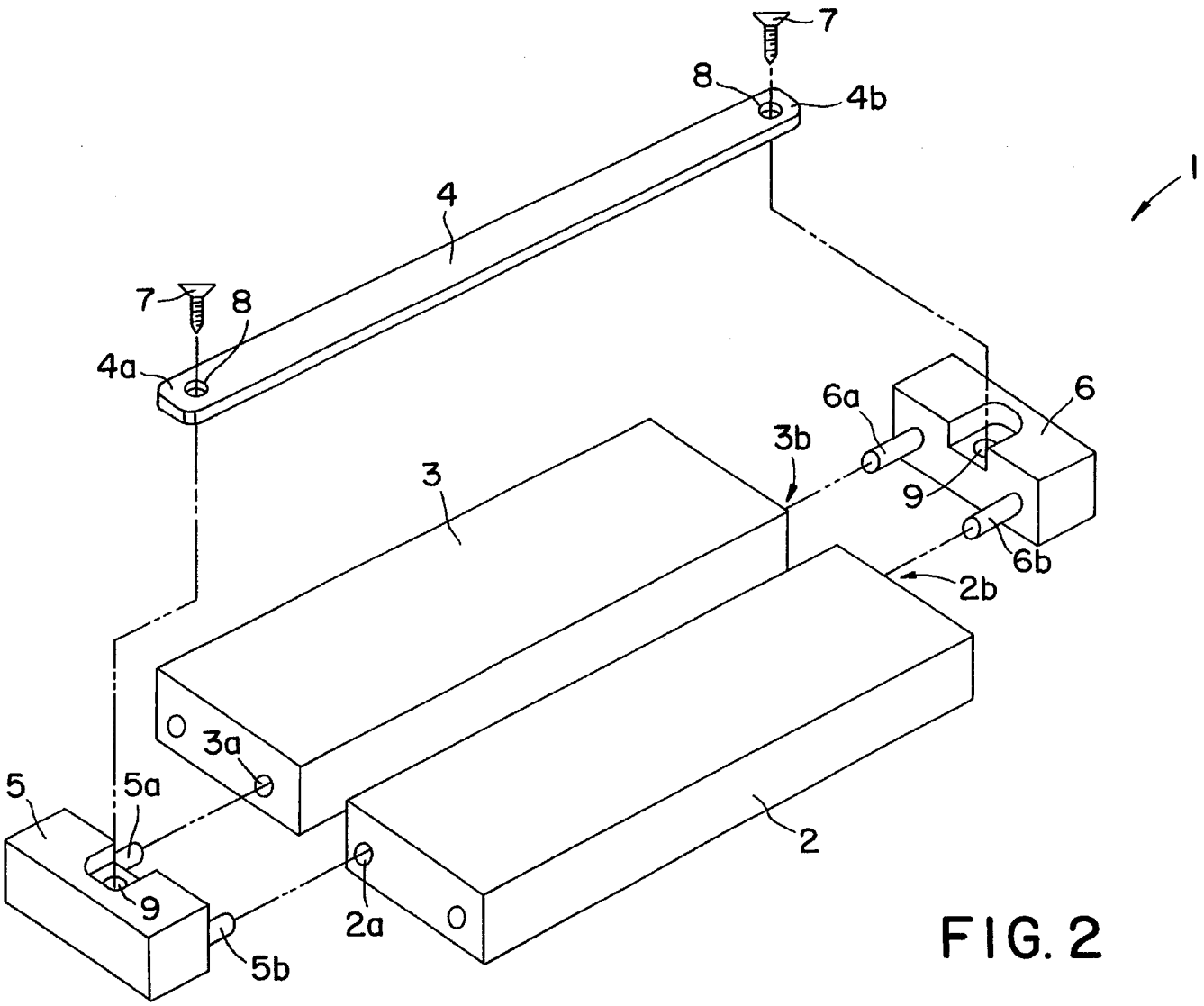
FIG. 2 represents an exploded view of the unit according to another preferred embodiment.

A second embodiment (see FIG. 2) of the jointed unit 1 provides for making small studs 6*a*, 6*b* and 5*a*, 5*b* integral with and protruding from the links 6, 5. The small studs them engage, free to rotate, into holes 3*b*, 2*b* and 3*a*, 2*a* made in the ends of the elements 2, 3 to be connected together with a technical and aesthetic result identical to that of the first embodiment.

It should be clear that the shape of the component parts, the system of fastening among the bars and the links, and the sizing of the parts themselves can vary according to specific requirements, while remaining within the scope of what is expressed in the attached claims.

Therefore, no limiting or binding significance is to be associated with the embodiments described.

I claim:

1. A jointed unit (1) comprising:

a plurality of pairs of adjacent elements (2, 3) connected to one another so as to be able to rotate in relation to each other;

a pair of links (5, 6) being situated at opposite ends of each pair of adjacent elements (2, 3), each link (5, 6) having a blind hole (9) recessed therein;

a bar (4) being connected to the pair of links (5, 6) and having a bore (8) through each of its opposite ends (4*a*, 4*b*); and means (7) for fastening the bar (4) to the links (5, 6) by passing through the bores (8) of the bar (4) into the blind holes (9) recessed in the links (5, 6);

whereby the bar (4) is situated in an intermediate position between the pair of adjacent elements (2, 3).

2. A jointed unit (1) according to claim 1, further comprising:

a plurality of studs (2*c*, 2*d*, 3*c*, 3*d*), each protruding from an end of one of the adjacent elements (2, 3).

3. A jointed unit (1) according to claim 2, wherein:

each of the links (5, 6) has at least one blind hole (5*c*, 5*d*, 6*c*, 6*d*) into which one of the studs (2*c*, 2*d*, 3*c*, 3*d*) fits so as to allow relative rotation between the links (5, 6) and the adjacent elements (2, 3) without excessive play.

* * * * *